US008752466B1

(12) United States Patent
Howell et al.

(10) Patent No.: US 8,752,466 B1
(45) Date of Patent: Jun. 17, 2014

(54) MODULAR AMMUNITION FEED CHUTE

(71) Applicant: Here Be Dragons, LLC, Oxford, ME (US)

(72) Inventors: Frank A. Howell, Oxford, ME (US); Justin A. Kiger, Standish, ME (US)

(73) Assignee: Here Be Dragons LLC, Oxford, ME (US)

( * ) Notice: Subject to any disclaimer, the term of this patent is extended or adjusted under 35 U.S.C. 154(b) by 52 days.

(21) Appl. No.: 13/692,333

(22) Filed: Dec. 3, 2012

Related U.S. Application Data

(60) Provisional application No. 61/567,767, filed on Dec. 7, 2011.

(51) Int. Cl.
*F41A 9/57* (2006.01)

(52) U.S. Cl.
CPC ..... *F41A 9/57* (2013.01)
USPC ..... 89/33.2; 89/33.14; 193/25 AC

(58) Field of Classification Search
CPC ..... F41A 9/57; F41A 9/56; F41A 9/55; F41A 9/54; F41A 9/00; F41A 9/79
USPC ..... 89/33.2, 33.14, 33.16, 33.25, 33.01; 193/25 AC, 25 R, 25 E, 25 A, 25 C
See application file for complete search history.

(56) References Cited

U.S. PATENT DOCUMENTS

| | | | | | |
|---|---|---|---|---|---|
| 2,351,370 | A | * | 6/1944 | Schaaff | 193/25 AC |
| 2,419,315 | A | | 4/1947 | Elliott | |
| 2,449,849 | A | * | 9/1948 | Holmes | 193/25 AC |
| 2,477,264 | A | * | 7/1949 | Pearson et al. | 193/25 AC |
| 2,488,679 | A | | 11/1949 | Nobles | |
| 2,510,191 | A | * | 6/1950 | Nobles | 193/25 AC |
| 2,673,634 | A | * | 3/1954 | Corbo | 193/25 AC |
| 2,740,180 | A | * | 4/1956 | Nobles | 24/613 |
| 2,819,780 | A | | 1/1958 | Fallon et al. | |
| 2,838,154 | A | * | 6/1958 | Van Fossen | 193/25 AC |
| 2,866,531 | A | * | 12/1958 | Nobles | 193/25 AC |
| 2,890,779 | A | * | 6/1959 | Aumann | 193/25 AC |
| 2,953,230 | A | * | 9/1960 | Aumann | 193/25 AC |
| 3,250,360 | A | * | 5/1966 | Correll | 193/25 AC |
| 3,307,452 | A | * | 3/1967 | Meunier | 89/33.14 |
| 3,563,357 | A | * | 2/1971 | West | 193/25 AC |
| 4,662,263 | A | * | 5/1987 | Titemore et al. | 89/33.14 |
| 4,939,978 | A | * | 7/1990 | Bishop et al. | 89/33.14 |
| 5,461,963 | A | * | 10/1995 | Sanderson | 89/37.22 |
| 5,471,904 | A | | 12/1995 | Armstrong | |
| 5,782,157 | A | | 7/1998 | Ellington et al. | |
| 8,356,539 | B2 | * | 1/2013 | Gonzalez | 89/33.2 |

* cited by examiner

*Primary Examiner* — Bret Hayes
*Assistant Examiner* — Joshua Freeman
(74) *Attorney, Agent, or Firm* — Gesmer Updegrove LLP

(57) ABSTRACT

A modular articulated guide assembly comprises a series of guide lugs disposed transversely relative to a longitudinal axis of flexure of the chute. The guide lugs have generally U-shaped bodies with laterally spaced side walls joined by bottom walls to define guide channels. Centerline tabs project forwardly from the bottom walls, with each centerline tab being slidably received in a central recess in the bottom wall of an adjacent guide lug. The centerline tabs are in an abutting relationship when the guide assembly is retracted on its axis of flexure, and are adapted to slide in their respective central recesses and to move apart when the guide assembly is extended along or flexed from its axis of flexure. The guide lugs are interlocked in a manner permitting their limited movement to accommodate extension and flexture of the guide assembly.

12 Claims, 10 Drawing Sheets

MODULAR AMMUNITION FEED CHUTE

CROSS REFERENCE TO RELATED APPLICATION

This application claims priority from U.S. Provisional Application Ser. No. 61/567,767 filed Dec. 7, 2011, the contents of which is incorporated herein in its entirety.

BACKGROUND

1. Field

This invention relates generally to modular articulated guide assemblies, and is concerned in particular with although not limited in use to feed chutes adapted to convey belted machinegun ammunition.

2. Description of Related Art

Soldiers engaged in combat must be able to operate belt-fed guns with a high degree of reliability. As belted machine-gun ammunition is pulled from its storage container by the weapon's firing cycle, the belt can swing, sag, twist, and/or snag, thus causing the weapon to jam. Feed chutes minimize these tendencies by supporting and guiding the ammunition belt.

There are three basic types of known ammunition feed chutes: A) Formed Sheet-metal, B) Nested Injection-molded Links with Wire-tensioned Interlocks, and C) Rigid. Guiding Frames.

Type A designs use stamped metal pieces that are formed into C-shaped lugs that are linked together by means of sliding, semi-flexible tabs. Type B designs use injection molded C-shaped lugs that are nested and held in contact with tensioning cables. Type C designs utilize a series of ridged frames that are connected by essentially ridged bridging structures.

Type B and Type C feed chutes are only suitable for use with weapons that are mounted in fixed positions relative to their ammunition sources.

Type A feed chutes offer the ability to extend and retract while flexing in multiple directions, thus making them useful for man-portable weapons. However, they gain this capability by making serious compromises. For example:

They are expensive to manufacture.

They are heavy.

They are vulnerable to impact damage.

The segments between the articulating joints are necessarily flat, requiring special low-friction surface treatments to promote the movement of the ammunition belt across the interior surfaces of the chute.

When damaged, they are difficult to repair in the field because specialized tooling and fixtures are necessary.

It is difficult to assemble/disassemble segments into preferred lengths because specialized tooling and fixtures are necessary.

The overlapping plate edges present on their interior surfaces create a snagging hazard, particularly when the chute is flexed in any direction.

SUMMARY

The modular articulated guide assembly of the present invention overcomes or at least significantly minimizes the above noted limitations of the prior art by shaping and interlocking individual guide lugs in a fundamentally different manner.

In exemplary embodiments of the invention to be described hereinafter in greater detail, the guide assembly comprises a series of guide lugs disposed transversely relative to a longitudinal axis of flexure of the feed chute. The guide lugs have generally U-shaped bodies with laterally spaced side walls joined by bottom walls to define guide channels, with the bottom walls having top surfaces interrupted by central recesses. Centerline tabs project forwardly from bottom walls, with each centerline tab being slidably received in the central recess of an adjacent guide lug. The centerline tabs are in an abutting relationship when the feed chute is retracted on its axis of flexure, and are adapted to slide in their respective central recesses and to move apart when the feed chute is extended along or flexed from its axis of flexure. The guide lugs are interlocked by floating locking bars in a manner permitting limited movement of the guide lugs to accommodate extension and flexture of the feed chute.

These and other features and advantages of the present invention will now be described in greater detail with reference to the accompanying drawings, wherein:

DETAILED DESCRIPTION

Figure 1:
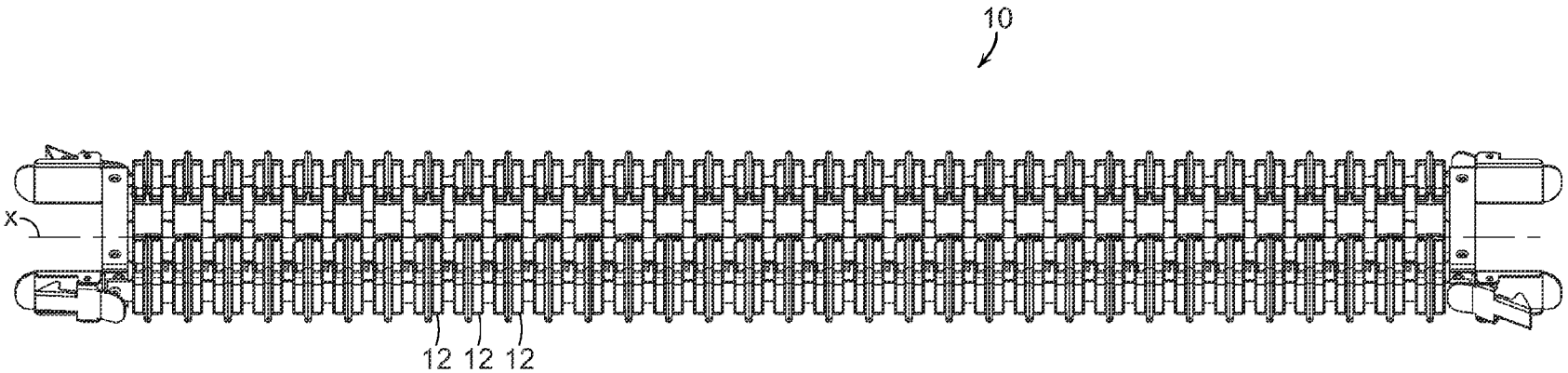
FIG. 1 is a top view of a modular articulated guide assembly in accordance with an exemplary embodiment of the present invention, with the guide assembly shown in its fully extended condition.
Figure 2:
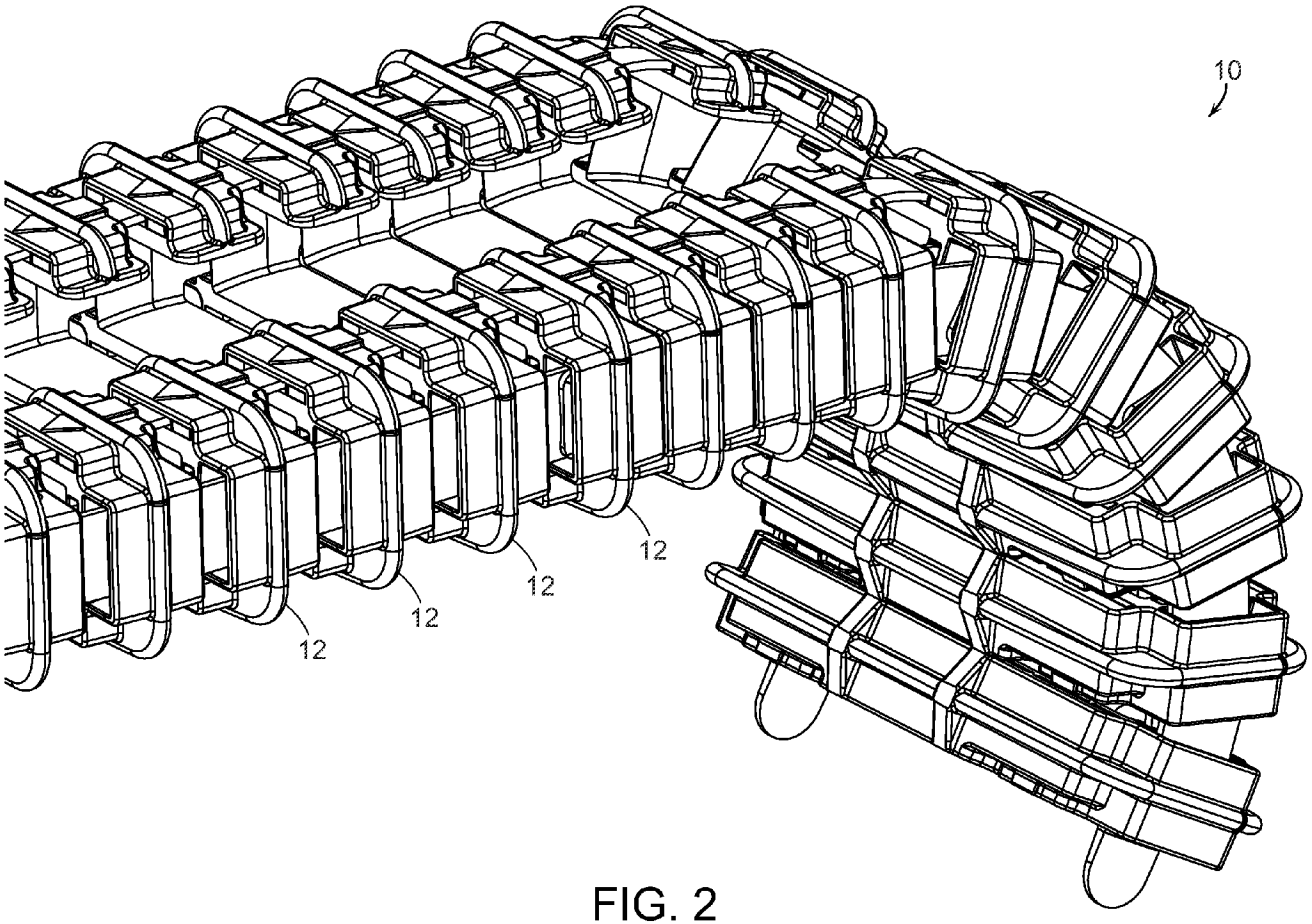
FIG. 2 is a perspective view on an enlarged scale showing the feed chute in a three dimensionally flexed condition.
Figure 3:
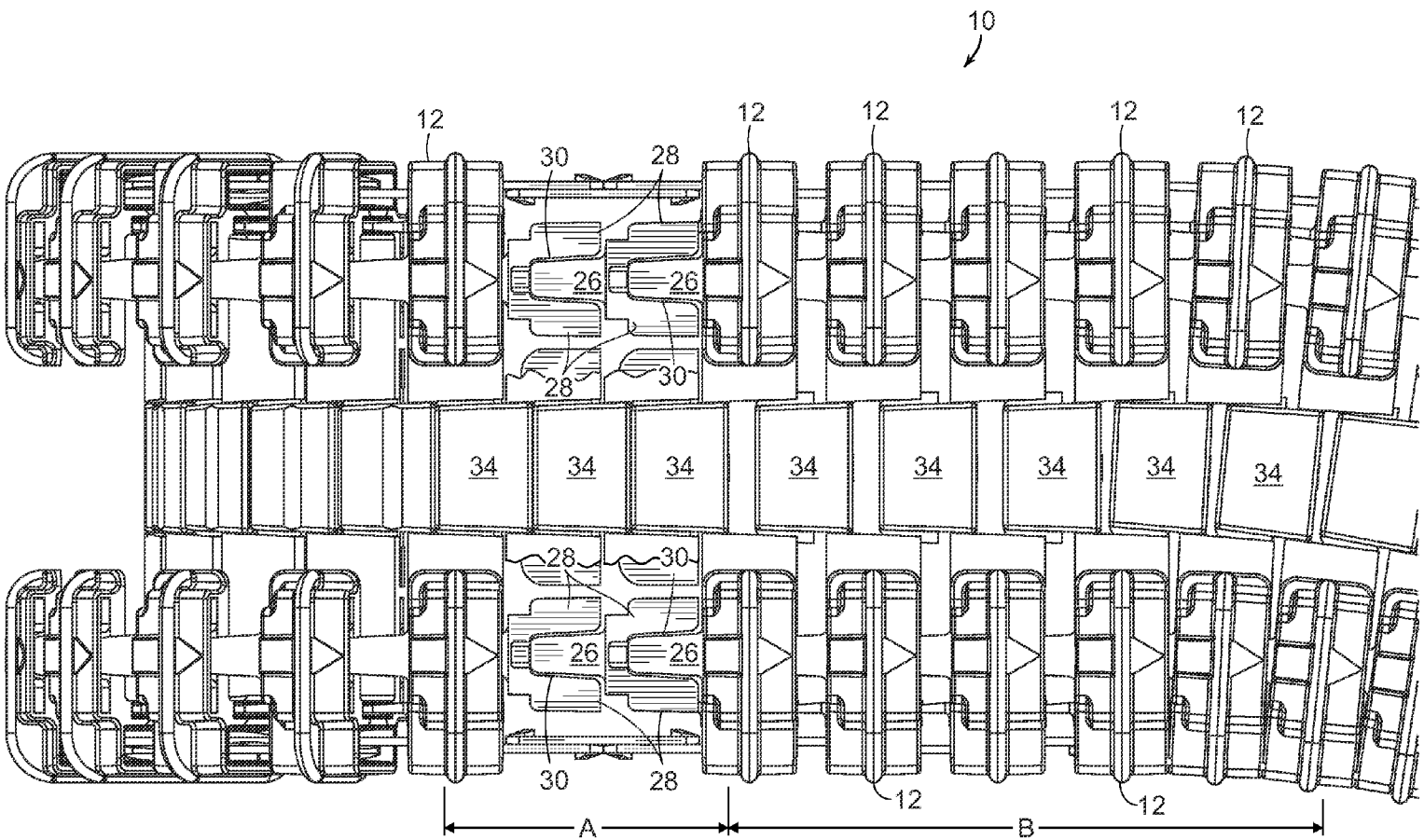
FIG. 3 is an enlarged top plan view, partially extended and deflected, and partially broken away, of a portion of the guide assembly.

With reference initially to FIG. 1-3, an exemplary embodiment of a modular articulated guide assembly in accordance with the present invention is generally depicted at 10. The guide assembly comprises a series of modular units indicated typically at 12 and interlocked in a manner permitting the feed chute to flex three dimensionally.

Figure 4:
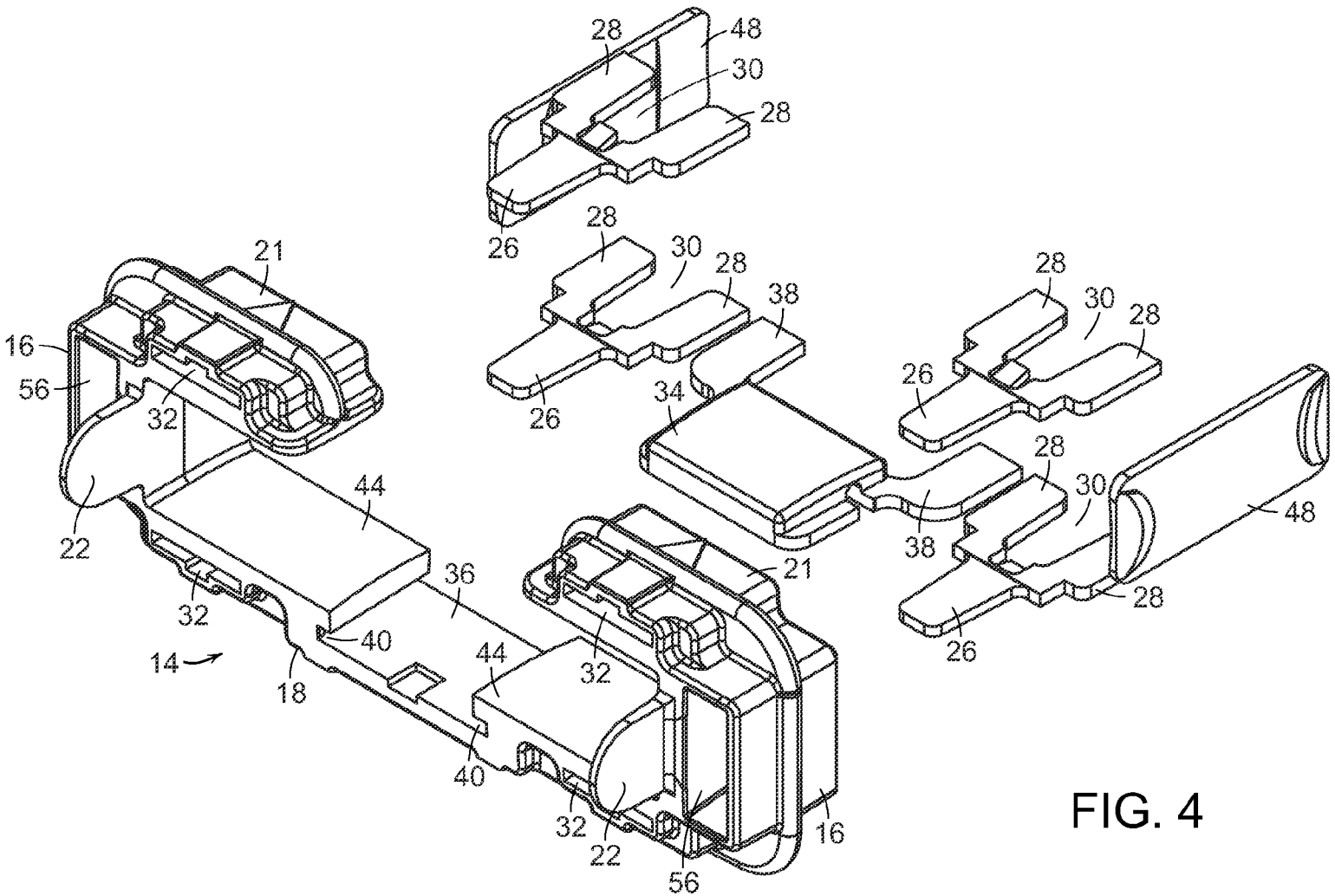
FIG. 4 is an exploded perspective view of the components comprising a modular unit of the guide assembly.
Figure 5:
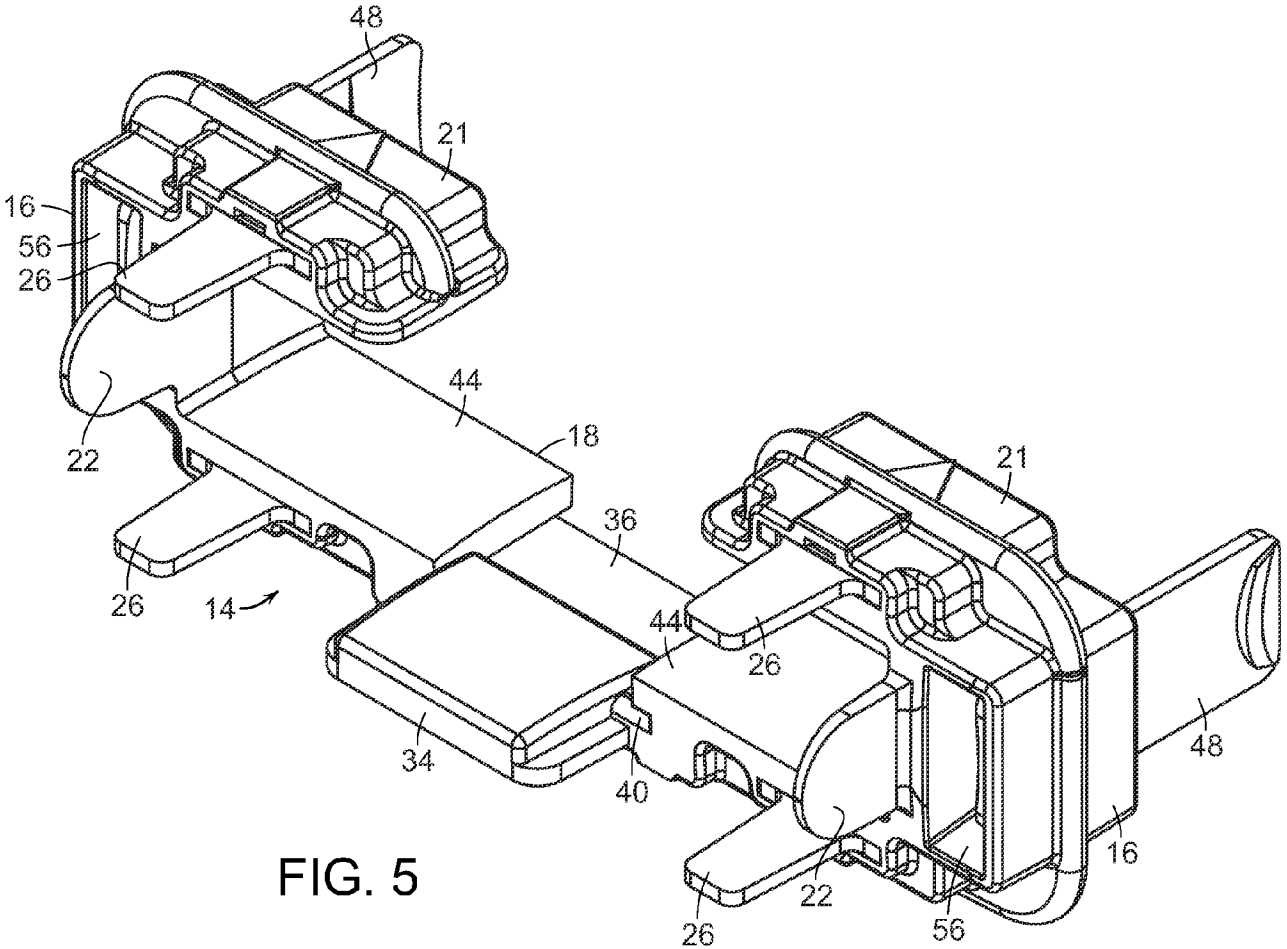
FIG. 5 is a perspective view showing the components of FIG. 3 in an assembled state.
Figure 6:
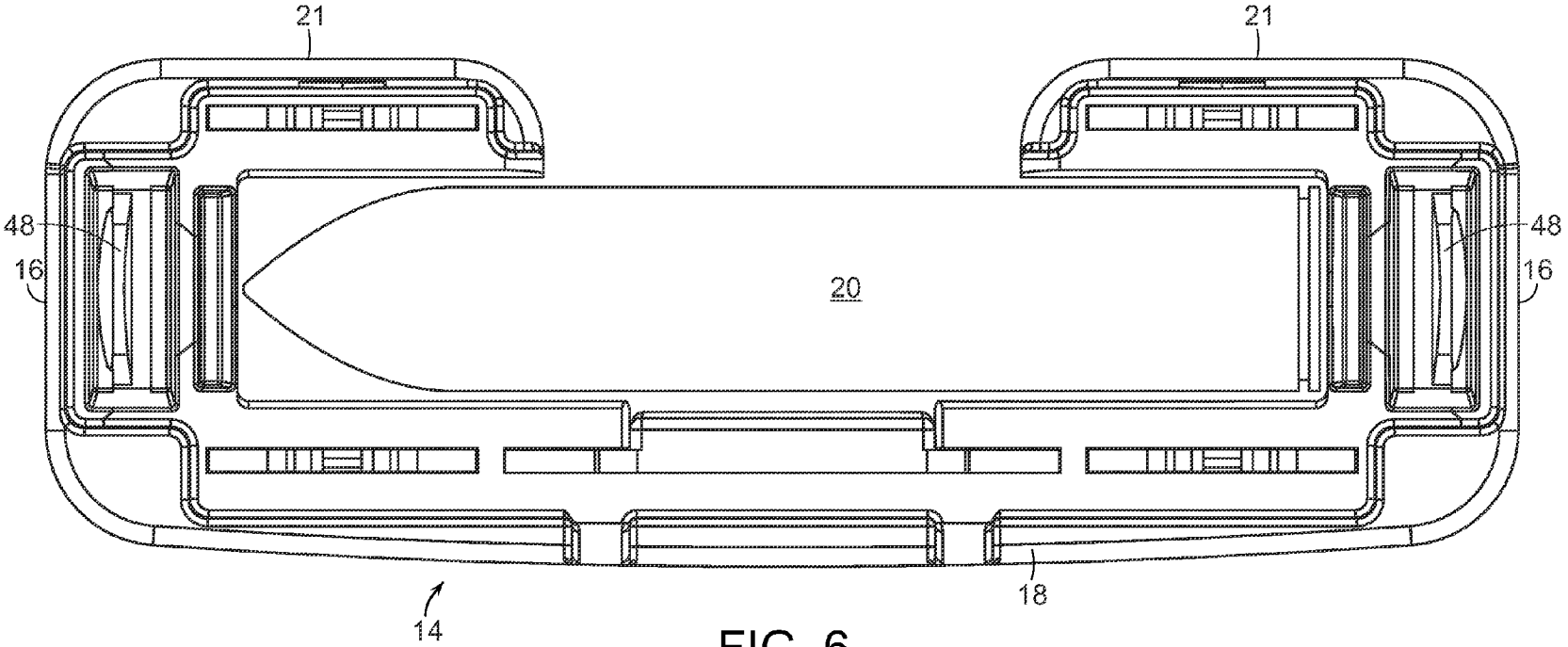
FIG. 6 is an enlarged cross sectional view of the guide assembly.

As shown in FIGS. 4-6, each modular unit 12 comprises a guide lug 14 having a generally U-shaped body with side walls 16 joined by a bottom wall 18 to define a guide channel. As shown in FIG. 6, and when designed to convey belted machine gun ammunition, the guide channel is configured to confine and guide cartridges 20. The side walls have cantilevered roof segments 21 overlying the guide channel, and integrally formed gap tabs 22 extending in parallel relationship with the guide channel. Y-shaped flexible guide tabs 26 have legs 28 separated by a gap 30. The legs 28 are configured for insertion into and snap engagement within slots 32 in the bottom wall 18 and the roof segments 21 of each guide lug. When thus inserted, as shown in FIG. 3, the guide tabs 26 project forwardly from each lug member into a slidable nested relationship in the gaps 30 between the legs 28 of guide tabs in adjacent lug members.

A centerline tab 34 projects forwardly from the bottom wall 18 of each guide lug 14. The centerline tab may either be snap engaged to the guide lug, or integrally molded thereto. Each centerline tab 34 overlaps and is slidably received in a central recess 36 in the top surface of the bottom wall of an adjacent guide lug. The centerline tabs 34 have rearwardly projecting stabilizing legs 38 received in notches 40 extending along the sides of its respective central recess 36.

It is important to note that the centerline tabs 34 do not overlap each other. Instead, as shown in the guide assembly section designated at "A" in FIGS. 3 and 7, the centerline tabs butt against each other when the guide assembly is in a retracted condition. When the guide assembly is extended or flexed out of a straight line, as shown for example at "B" in FIGS. 3 and 7, the centerline tabs 34 slide and move apart in their respective central recesses 36.

Figure 7:
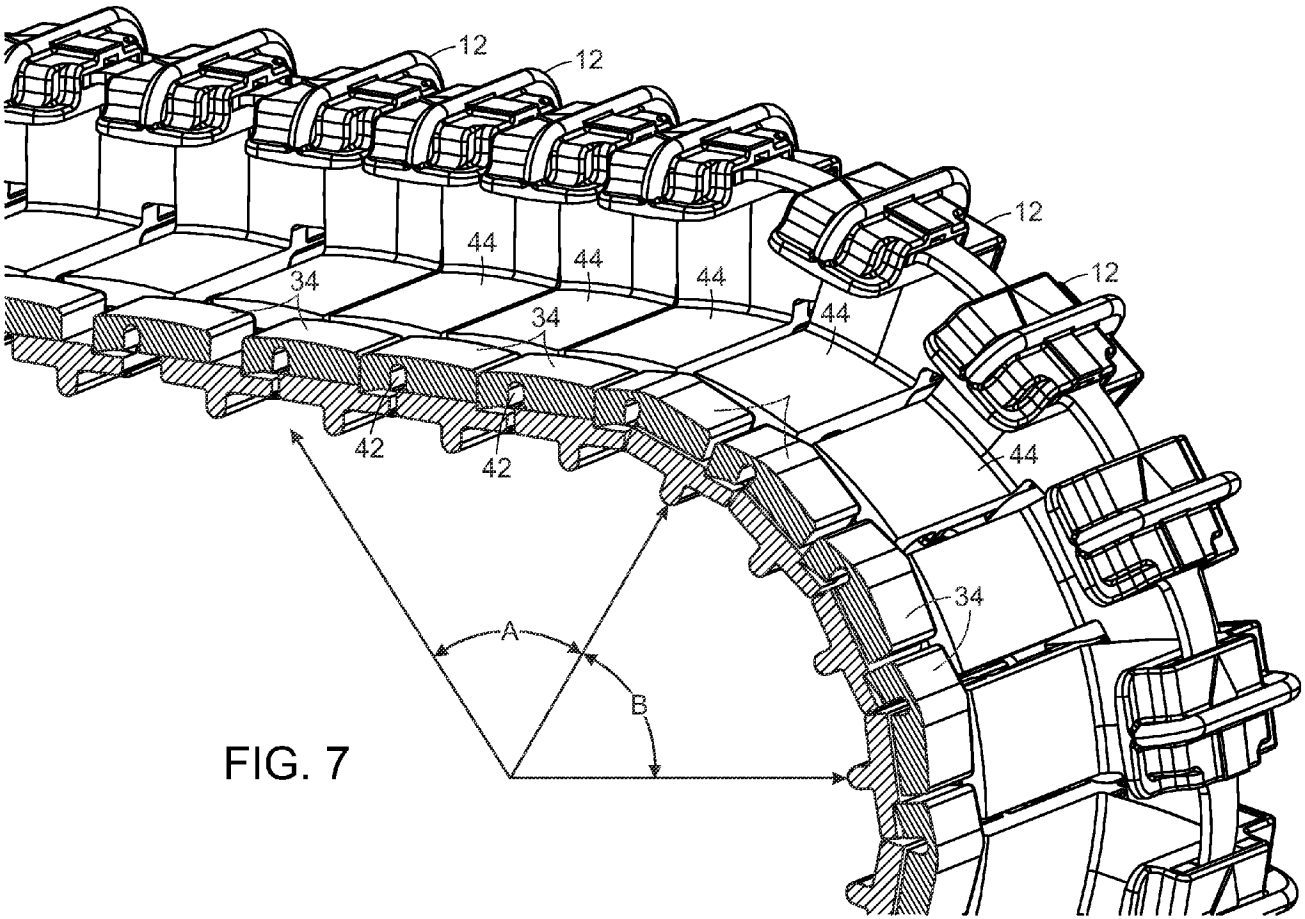
FIG. 7 is a three dimensional longitudinal section through the guide assembly.

As can be best seen in FIG. 7, to allow the guide assembly to curve, the undersides of the centerline tabs 34 are provided with transverse hinge slots typically indicated at 42 which create a thin flexible cross section that is coincidental with the abutting edges of the adjacent guide lugs 14.

Again, with reference to FIG. 7, the top surfaces 44 of the bottom walls 18 on either side of the central recesses 36, and the top surfaces of the centerline tabs 34 are convex. These convex surfaces ramp upward to crest at the centers of each guide lug, then ramp downwardly. When the guide assembly is in a straight line (section "A" in FIGS. 3 and 7), these convex surfaces reduce the amount of surface area that contacts the belted ammunition, with the ammunition riding only on the crests of the lugs. This reduces the amount of friction, thereby minimizing the amount of force required to transport the belted ammunition through the feed chute.

As the guide assembly is progressively curled (section "B" in FIGS. 3 and 7), the crests gradually disappear as the ramps create a smooth curving surface. Though frictional surface area in the interior of the guide assembly is increased, the surface that the ammunition belt is passing over is free of step-like seams that are a significant liability of overlapping guide surfaces.

Figure 9:
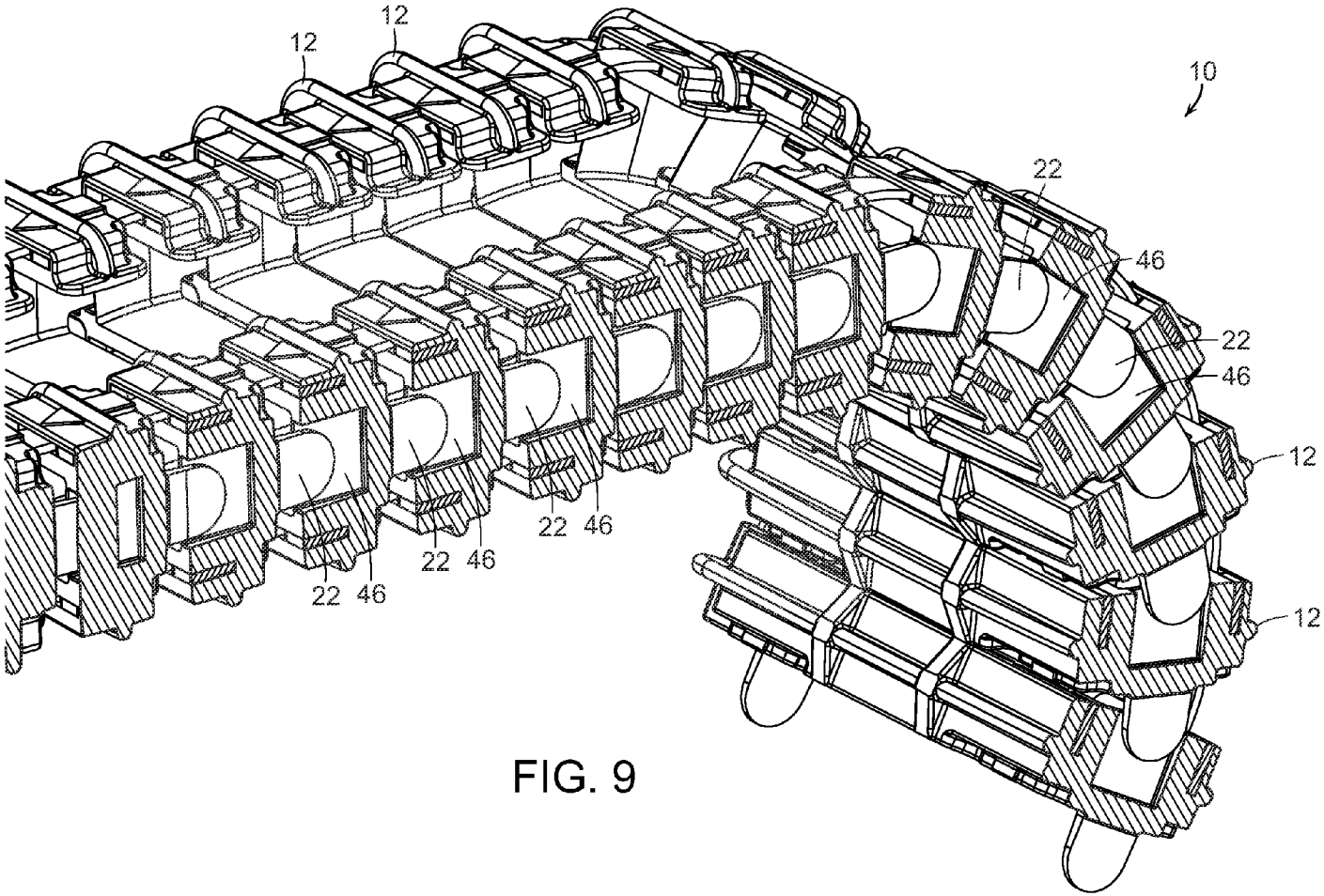
FIG. 9 is a view similar to FIG. 2 with one side of the guide assembly broken away to show the telescopic arrangement of the gap tabs.

When the guide assembly is flexed away from its longitudinal axis of flexure (denoted as "x" in FIG. 1), problematic gaps could form between the guide lugs 14. This is overcome by the gap tabs 22 that protrude from "male" sides of the guide lugs. As shown in FIG. 9, the gap tabs 22 are slidably received in recesses 46 in "female" sides of adjacent lugs. The tips of the gap tabs are rounded to allow them to articulate as the guide assembly is flexed and can move in or out of the recesses 46 as needed to keep the rounded tips of cartridges 20 from snagging in gaps between the lugs and stopping the movement of the ammunition belt.

Figure 10:
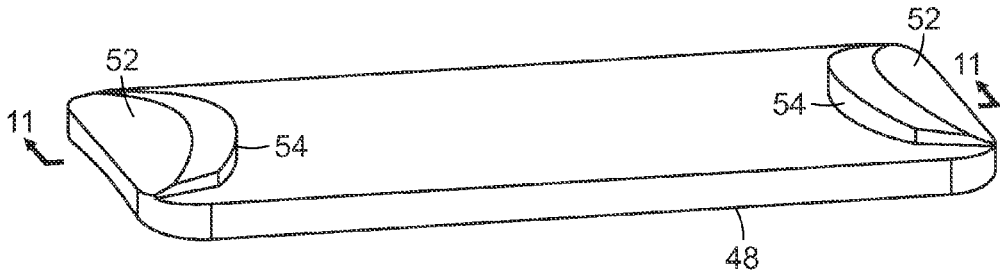
FIG. 10 is a perspective view of a floating lock bar.
Figure 11:
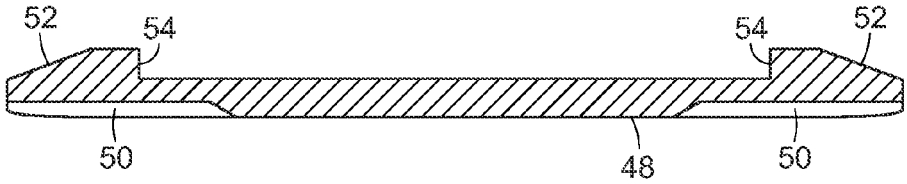
FIG. 11 is a sectional view of the floating lock bar taken along line 11-11 of FIG. 10.
Figure 12:
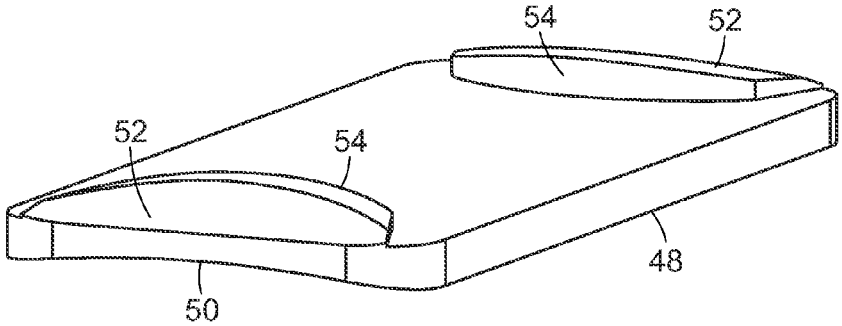
FIG. 12 is another perspective view of the floating lock bar.

The modular units 12 of the guide assembly 10 are interconnected by floating lock bars 48. As shown in FIGS. 10, 11 and 12, the floating lock bars comprise generally flat rectangular plates with contoured opposite ends configured with concave undersides 50 providing bow-shaped spring ends with ramped top surfaces 52 leading to hook-shaped ends 54.

Figure 8:
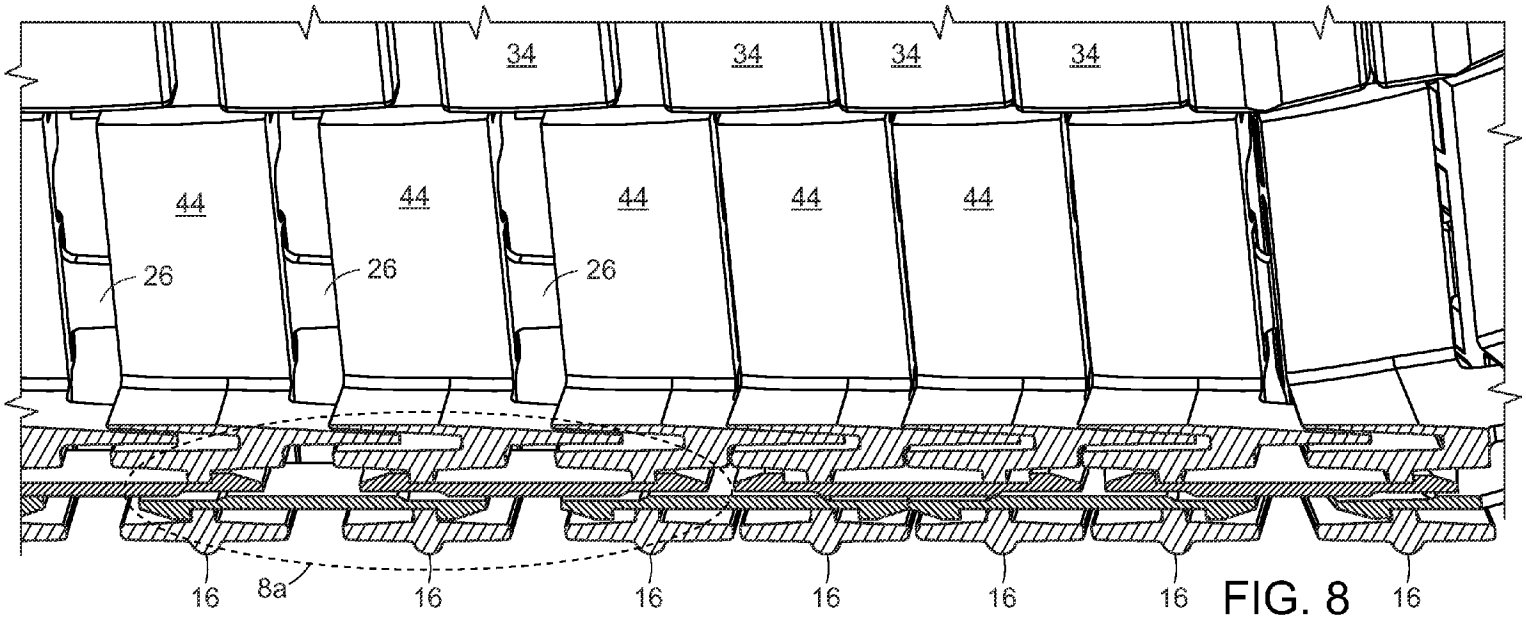
FIG. 8 is a horizontal section through one side of the guide assembly.
Figure 8A:
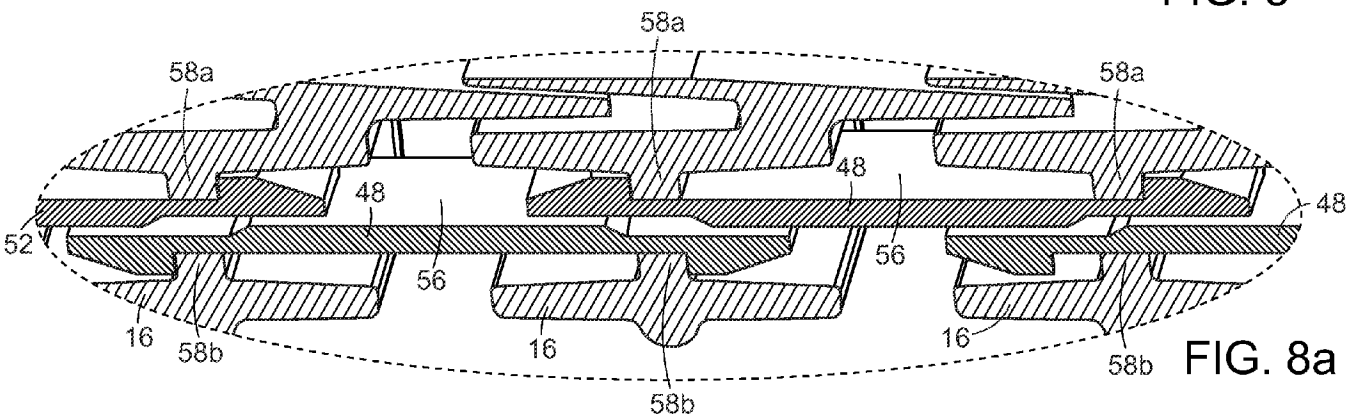
FIG. 8A is an enlarged view of the portion surrounded by a broken line in FIG. 8.

As shown in FIGS. 4 and 5, the side walls 16 of the lugs 14 are hollow and define generally rectangular through passages 56. With further reference to FIGS. 8 and 8A, it will be seen that the interior surfaces of the passages 56 are provided with mutually spaced inwardly projecting inboard and outboard locking ribs 58*a*, 58*b*. The floating lock bars 52 are inserted in a back-to-back staggered overlapping inboard and outbound relationships in the through passages 56 of the guide lugs, with the hook-shaped ends 54 of each inboard locking bar engaging an inboard locking rib 58*a* of each guide lug 14 and an adjacent preceding guide lug, and with the hook-shaped ends of each outboard locking bar engaging an outboard locking rib 58*b* on each guide lug and an adjacent succeeding guide lug.

The back to back stacking of the locking bars allows the "hook-less" flat sides to slide past each other, thus allowing the guide lugs to extend, retract, and twist in relation to each other. When guide lugs are assembled this way to build a guide assembly, the desired range of motion is achieved.

The bow-shaped spring ends 50 co-act with the ramped top surface 52 during insertion into the guide lugs. The bow-shaped spring ends of the lock bars are flattened as the ramped surfaces 52 press against the vertical locking ribs 58*a*, 58*b* of the guide lug during assembly. Once past the locking ribs, the lock bar ends snap back into position with the hook-shaped ends engaging the locking ribs, thus capturing the respective guide lugs.

The modular articulated guide assembly of the present invention is not limited in use to the conveyance of belted ammunition. Other potential uses include, for example, articulated load bearing columns incorporated in harnesses or the like as part of equipment carried by military combat personnel.

While exemplary embodiments of the invention have been disclosed, modifications, additions and deletions can be made without departing from the spirit and scope of the invention, and its equivalents, as set forth in the following claims.

We claim:

1. A modular articulated guide assembly, comprising:

a series of guide lugs disposed transversely relative to a longitudinal axis of flexure of said guide assembly, said guide lugs having generally U-shaped bodies with laterally spaced side walls joined by bottom walls to define guide channels, said bottom walls having top surfaces interrupted by central recesses;

centerline tabs projecting forwardly from said bottom walls, each centerline tab being slidably received in the central recess of an adjacent guide lug, said centerline tabs being in an abutting relationship when said chute is retracted on said axis of flexure, and being adapted to slide in their respective central recesses and to move apart when said feed chute is extended along or flexed from said axis of flexure; and means for interlocking said guide lugs in a manner permitting limited movement of said guide lugs to accommodate extension and flexure of said chute.

2. The guide assembly of claim 1 wherein the top surfaces of said bottom walls and said center line tabs are convex.

3. The guide assembly of claim 1 wherein said centerline tabs are snap engaged in said guide lugs.

4. The guide assembly of claim 1 wherein said centerline tabs have rearwardly projecting legs received in notches extending along sides of said central recesses.

5. The guide assembly of claim 1 wherein undersides of said center line tabs have transverse hinge slots which create flexible cross sections of reduced thickness that are aligned with abutting edges of adjacent guide lugs.

6. The guide assembly of claim 1 further comprising guide tabs with rearwardly projecting resilient parallel legs configured for snap engagement in receiving slots in said guide lugs, said guide tabs being arranged to project forwardly from each guide lug and into a slidable nested relationship between the legs of a guide tab snap engaged in a respective receiving slot of an adjacent lug member.

7. The guide assembly of claim 6 wherein said guide tabs are snap engaged in receiving slots in the bottom walls of said guide lugs.

8. The guide assembly of assembly of claim 6 further comprising cantilevered roof segments projection from said side walls to overlie said guide channel, with said guide tabs additionally snap engaged in receiving slots in said roof segments.

9. The guide assembly of claim 1 wherein said side walls are hollow and define through passages having opposed interior surfaces parallel to said guide channel, locking ribs on said interior surfaces, and locking bars having hook-shaped ends received in the through passages of adjacent guide lugs, the hook-shaped ends of said locking bars being engageable with said locking ribs to limit the extent to which said guide lugs may be separated one from the other during extension and flexure of said chute.

10. The guide assembly of claim 9 wherein said interior surfaces have inboard and outboard opposed locking ribs, wherein inboard and outboard locking bars are arranged in said through passages in a staggered overlapping relationship, with the hook-shaped ends of said inboard locking bars engaging the inboard locking ribs of each guide lug and an adjacent preceding guide lug, and with the hook-shaped ends of the outboard locking bars engaging the outboard locking ribs of each guide lug and the adjacent succeeding guide lug.

11. A modular articulated guide assembly, comprising:

a series of guide lugs disposed transversely relative to a longitudinal axis of flexure of said guide assembly, said guide lugs having generally U-shaped bodies with laterally spaced side walls joined by bottom walls to define guide channels, said sidewalls defining through passages with opposed interior surfaces parallel to said guide channel;

centerline tabs projecting forwardly from said bottom walls;

locking ribs on the interior surfaces of said through passages; and locking bars having hook-shaped ends received in the through passages of adjacent guide lugs, the hook-shaped ends of said locking bars being engageable with said locking ribs to limit the extent to which said guide lugs may be separated one from the other during extension and flexure of said chute.

12. A modular articulated guide assembly, comprising:

a series of guide lugs disposed transversely relative to a longitudinal axis of flexure of said guide assembly, said guide lugs having generally U-shaped bodies with laterally spaced side walls joined by bottom walls to define guide channels, with cantilevered roof segments projecting from said side walls to overlie said guide channel, and with said bottom walls having top surfaces interrupted by central recesses;

centerline tabs projecting forwardly from said bottom walls, each centerline tab being slidably received in the central recess of an adjacent guide lug, said centerline tabs being in an abutting relationship when said chute is retracted on said axis of flexure, and being adapted to slide in their respective central recesses and to move apart when said feed chute is extended along or flexed from said axis of flexure;

guide tabs with rearwardly projecting resilient parallel legs configured for snap engagement in receiving slots in the bottom walls and roof segments of said guide lugs, said guide tabs being arranged to project forwardly from each guide lug and into a slidable nested relationship between the legs of guide tabs snap engaged in respective receiving slots of an adjacent lug member; and means for interlocking said guide lugs in a manner permitting limited movement of said guide lugs to accommodate extension and flexure of said chute.

* * * * *